United States Patent [19]

Baumeyer et al.

[11] 4,386,713

[45] Jun. 7, 1983

[54] FULL OPENING STEEL CAN END CONSTRUCTION

[75] Inventors: Phillip E. Baumeyer, North Canton; Karl O. Frentzel, Canton; William A. Kirk, Clinton; Gary L. Manack, Brewster, all of Ohio

[73] Assignee: Van Dorn Company, Cleveland, Ohio

[21] Appl. No.: 351,869

[22] Filed: Feb. 24, 1982

[51] Int. Cl.[3] ..... B65D 17/34

[52] U.S. Cl. ..... 220/269; 220/273; 413/14

[58] Field of Search ..... 220/269–273, 220/276; 113/121 C

[56] References Cited

U.S. PATENT DOCUMENTS

| | | | |
|---|---|---|---|
| 3,871,314 | 3/1975 | Stargell | 113/121 C |
| 4,042,144 | 8/1977 | Henning et al. | 220/273 |
| 4,116,360 | 9/1978 | McKernan et al. | 220/273 |
| 4,116,361 | 9/1978 | Stargell | 220/273 |
| 4,182,460 | 1/1980 | Holk, Jr. et al. | 220/271 |

*Primary Examiner*—George T. Hall

*Attorney, Agent, or Firm*—Frease & Bishop

[57] ABSTRACT

A substantially full opening steel can end for food product cans easily opened by an aluminum pull tab riveted to a removable panel portion defined by a score line in a recessed end wall of the can end located close to a seam between the can end and can body. The panel portion has a protective triple fold formation along its peripheral edge when removed, and the score line is located in the top layer of the triple fold formation beneath an overlying stepped tip of the pull tab which ruptures the score line during opening of the can. The score line preferably extends 300°, 150° in each direction from the stepped pull tab tip, around the can end to retain the opened panel portion and pull tab on the can when opened.

9 Claims, 21 Drawing Figures

FULL OPENING STEEL CAN END CONSTRUCTION

BACKGROUND OF THE INVENTION

1. Field of the Invention

The invention relates to food product cans provided with can end members which may be opened easily by tearing a panel portion of the end along a score line with a ring pull tab. More particularly the invention relates to such can ends fabricated from light gauge steel from which the torn panel portion when torn leaves a substantially full opening in the can end. The pull tab is riveted to the panel portion to be torn and is formed of aluminum. Tearing proceeds along the score line located in the steel end very close to a usual double seam which connects the can end to one end of a generally cylindrical steel can body. The score line preferably extends less than 360°, say 300°, around the can end adjacent the double seam, so that the torn panel portion remains connected with the can end at the opening thus formed with the pull tab connected thereto.

Also, the invention relates to the described steel can end in which the periphery of the torn panel portion is formed with a protective triple fold generally of the type shown in U.S. Pat. No. 4,116,360 wherein the score line is located in the top triple fold layer, and the can end is initially ruptured on the score line by the nose or tip of a pull tab generally of the type shown in U.S. Pat. No. 4,042,144.

In addition, the invention relates to the described steel can end with an aluminum pull tab riveted thereto having special rivet characteristics imparted during rivet formation combined with a specially shaped and located moustache type score adjacent the rivet to assist in ease of opening the can end without tearing the pull tab from the panel portion being torn from the can end when the can is being opened.

Finally, the invention relates to a new steel can end construction described in detail below involving an interrelation of the forms, shapes, compositions, characteristics and cooperative arrangements of the various components combined to form the new can end.

2. Description of the Prior Art

Steel can ends for beverage cans are known having small teardrop- or keyhole-shaped pouring openings formed in the can end wall by pulling keyhole-shaped metal completely from the can end with a pull tab attached to the removed metal.

Also, beverage cans are known which have pull tabs attached to torn teardrop metal portions, both of which remain attached to the can after forming the pouring opening. In general, the torn out metal portion remains inside the can and there is no protective edge formation on such torn metal portion inside the can. Some of such prior can ends may have been made from steel but it is exceedingly hard or difficult to open such steel can ends.

Still another steel can end seamed to a steel can and provided with a steel pull tab having a so-called moustache cut behind the rivet is known. Such a can end is exceedingly hard and difficult to open. Such prior steel cans are intended to provide a full opening by completely tearing a panel portion from the can to form a full opening. The torn out panel portion has a protective edge formed by a peripheral triple fold.

The score line in this prior device is located in the bottom layer of the triple fold below and concealed by the reversely bent two top triple fold metal layers. The panel portion to be removed extends from and in the plane of the top layer of the triple fold. Such particular score line location and triple fold arrangement in said prior device is believed to contribute among other matters to the great difficulty encountered in opening such a can end. Frequently, in attempting to open such prior device with the steel pull tab riveted thereto, the pull tab tears away from the can end leaving the can unopened.

We are not aware of any prior art steel can end from which a full or substantially full opening panel may be very easily torn along an opening-defining score line with an aluminum pull tab riveted to the panel to be torn, and in which the torn panel portion has a protective triple fold formation along its torn edge.

Accordingly, there is an existing need in the art for full opening cans provided with steel can ends which may be easily opened with an aluminum pull tab riveted to a full or substantially full opening panel portion by tearing along a score line located close to a seam between the can end and can body, and in which the torn panel portion has a protective triple fold formation along its peripheral edge.

SUMMARY OF THE INVENTION

Objectives of the invention include providing a new substantially full opening steel can end construction having a panel portion that may be torn easily from the can end along a score line with a pull tab riveted thereto; providing such new can end construction in which the torn out panel portion has a protective triple fold peripheral edge, in which the can end is formed from a particular type of light gauge steel, and in which the can end has a particular shape or contour in cross section; providing such new steel can end construction in which the pull tab is formed of aluminum that has a special stepped tip or nose cooperatively related to the can end contour and its triple fold formation which forms the protective edge when the panel portion is torn from the can end, and to the location of the score line defining the can opening when the panel portion is torn from the ean end; providing such new steel can end construction in which the score line formed in the can end is located close to the seam between the can end and can body and extends preferably short of 360° around the can end to retain with the can the torn panel portion when torn from the can end along the score line; providing such new steel can end construction in which the score line is located in the upper surface of the top layer of the triple fold formation in the can end and has a critical residual dimension, that is metal thickness from the bottom of the V-shaped in section score line to the under surface of the thin metal scored, to permit on the one hand easy rupturing and opening of the can end, and to enable on the other hand the steel can end construction to qualify for required U.S.D.A. Drop Tests; providing such new steel can end construction with new rivet means connecting the aluminum pull tab to the steel can end characterized by dimensional requirements and modified steps of forming the rivet before staking it to the pull tab to obtain a satisfactory and efficient full overlap of the rivet metal integral with the can end when staking the pull tab to the can end; providing such new steel can end construction with a moustache cut score line cooperatively related to the new rivet means to encompass the rear rivet portion and to extend in the panel laterally outward of the side rivet portions and to terminate in curved extremities lying laterally in front of the front portion of the rivet means, said rivet-encompassing portion of the moustache cut located at the rear of the rivet being related to the location of the nose or top of the pull tab in front of the rivet; providing such new steel can end construction with the interrelated and cooperative relationship and arrangement of the various components of the can end and their characteristics, such that the pull tab may be in prestressed condition from the rivet to its tip when staked to the can end, and may be raised readily when grasped in a user's fingers to pop the moustache cut open, accompanied immediately by rupturing the score line beneath and by the pull tab tip as it wipes across the score line during continued leverage and raising of the pull tab, whereupon upward pull on the pull tab tears the panel portion along the score line at either side of the initially ruptured portion to a substantially full open position; and providing a new steel can end construction, formation and mode of operation in use which achieves the stated objectives and overcomes difficulties encountered in past attempts to provide easy opening, full opening steel can ends, in a reliable and effective manner, which can end construction is relatively inexpensive as compared with prior full opening triple fold protected aluminum can ends.

These and other objectives and advantages may be obtained by the steel can end construction which may be stated in general terms as involving a metal can end of a type having a seam flange adapted to be connected by seam means to a food products can body and having a recessed corner located below the seam flange with an end wall extending inward from the recessed corner, and having a triple fold formation extending entirely around the end wall, with a score line located close to said recessed corner and extending around the end wall in the top layer of the triple fold defining a removable panel portion in the end wall, with the triple fold forming a protective peripheral edge on the panel portion when torn along the score line by an aluminum pull tab connected by a rivet formed integrally in the panel portion and located close to the score line, and with the removable panel portion of the end wall extending flatwise inward in the plane of the bottom layer of the panel portion protective peripheral triple fold formation, the pull tab having a flat nose bottom wall with an opening formed in its rear portion through which the rivet extends when the pull tab is staked to the removable panel portion and with a stepped tip formed at its front terminal portion and with its flat bottom wall held flatwise around the rivet by the rivet in contact with the flatwise extending panel portion when staked by the rivet to the panel portion; wherein the improvement comprises an annealed, tempered, tin-free steel can end; the pull tab stepped tip engaging the triple fold formation at an inner portion of the top layer of the triple fold where it curves downwardly to join the middle triple fold layer; the outer end of the stepped tip overlying the score line; and a moustache cut formed in the upper surface of the flatwise extending panel portion close to the rivet and encompassing the rear and sides of the rivet and terminating in wings lying laterally in front of the front portion of the rivet.

BRIEF DESCRIPTION OF THE DRAWINGS

Preferred embodiments of the invention—illustrative of the best mode in which applicants have contemplated applying the principles—are set forth in the following description and shown in the drawings and are particularly and distinctly pointed out and set forth in the appended claims.

Figure 16:
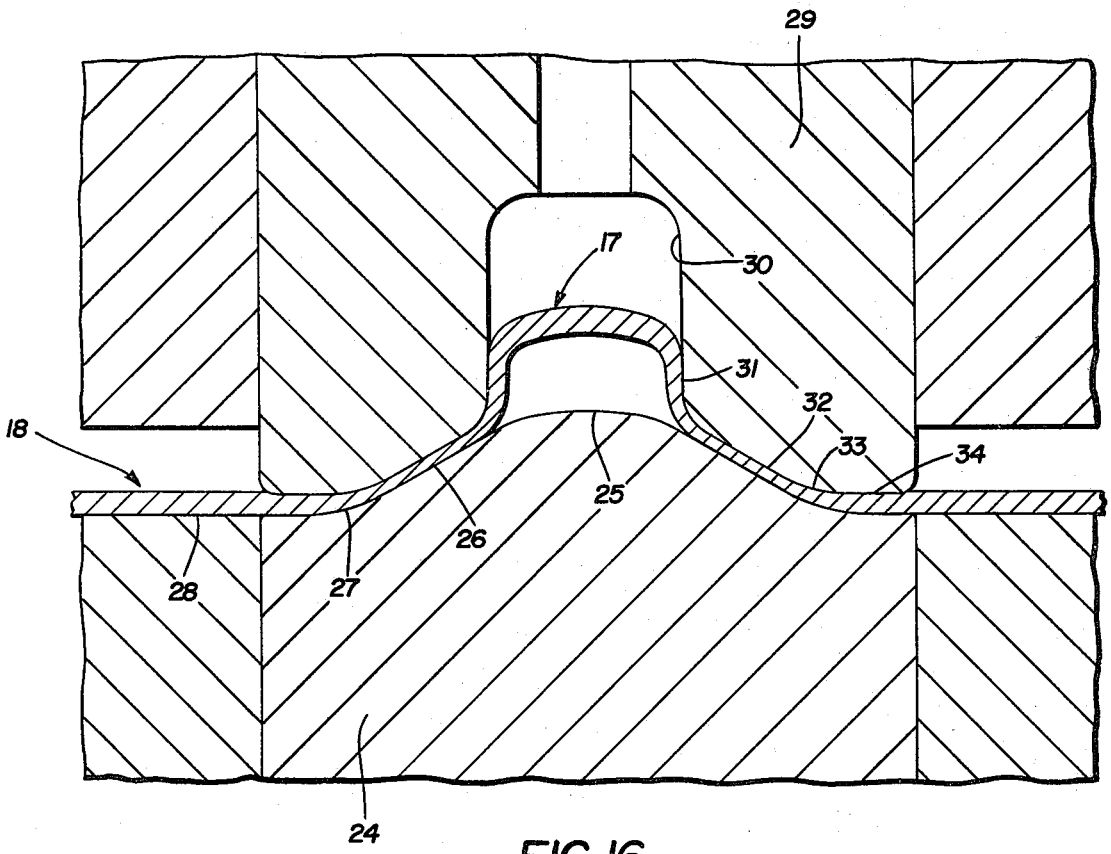
Figure 3:
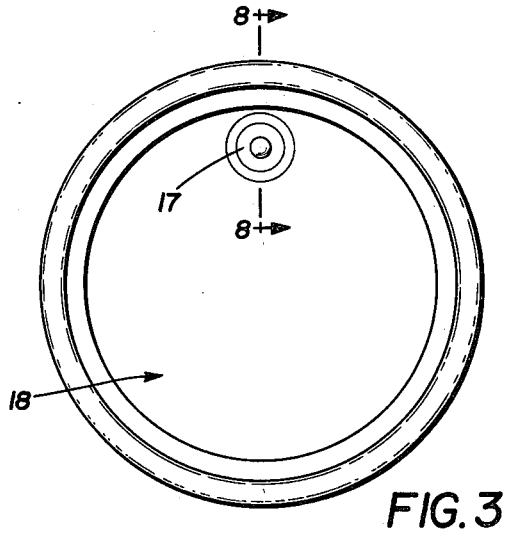
FIG. 3 is a view similar to FIG. 2 showing a first step of forming a bubble from which a rivet is formed.
Figure 6:
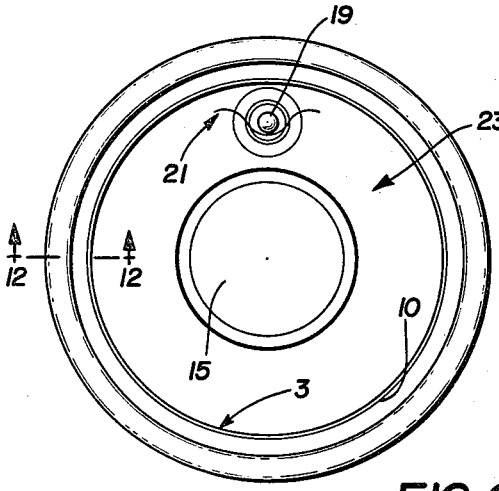
FIG. 6 is a similar view illustrating a triple fold formation incorporated in the stage blank of FIG. 5.
Figure 7:
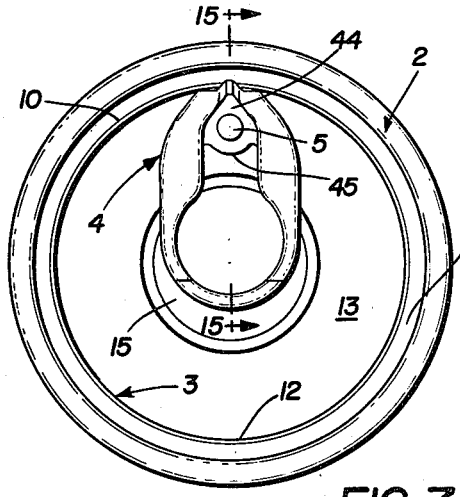
FIG. 7 is a similar view of a completed steel can end with an aluminum pull tab staked by the rivet to the can end.
Figure 8:
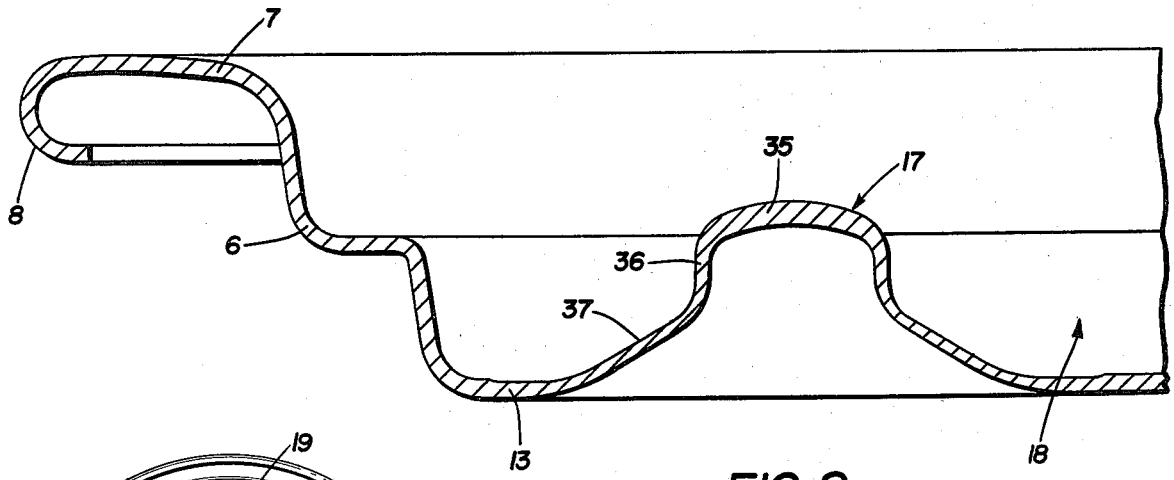
FIG. 8 is an enlarged fragmentary section looking in the direction of arrows 8—8, FIG. 3.
Figure 14:
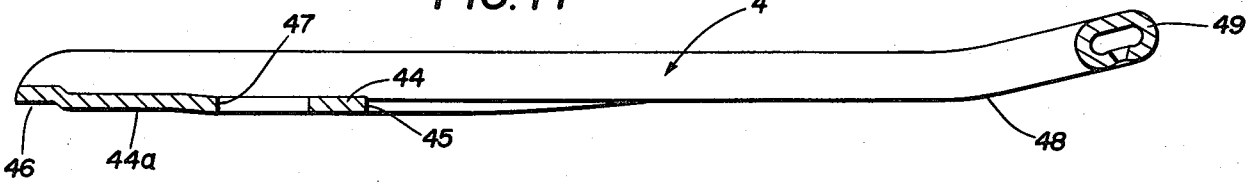
Figure 15:
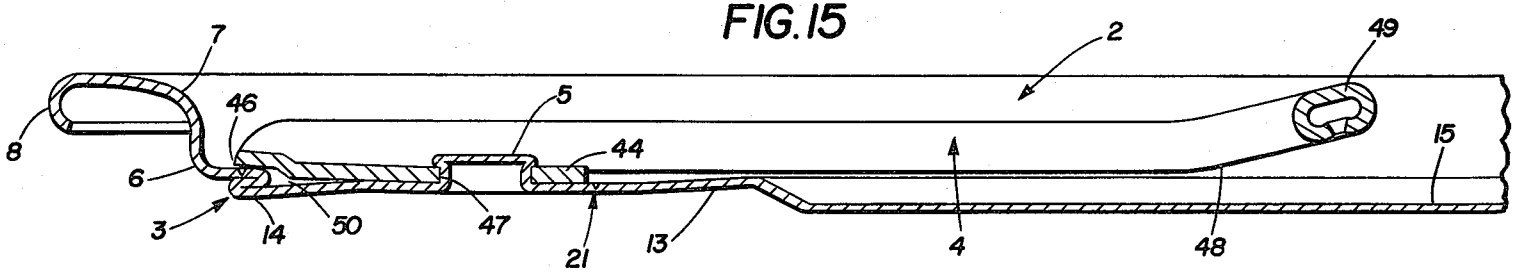
Figure 17:
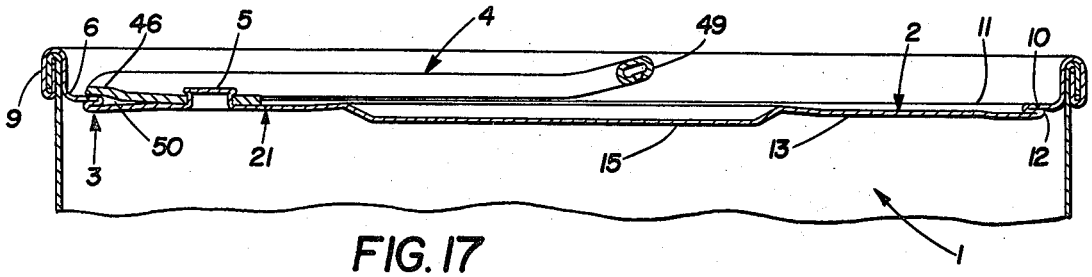
Figure 18:
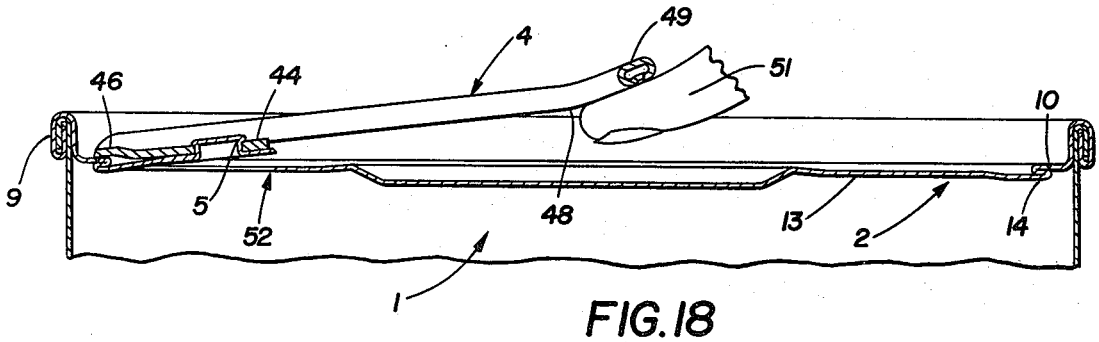
Figure 19:
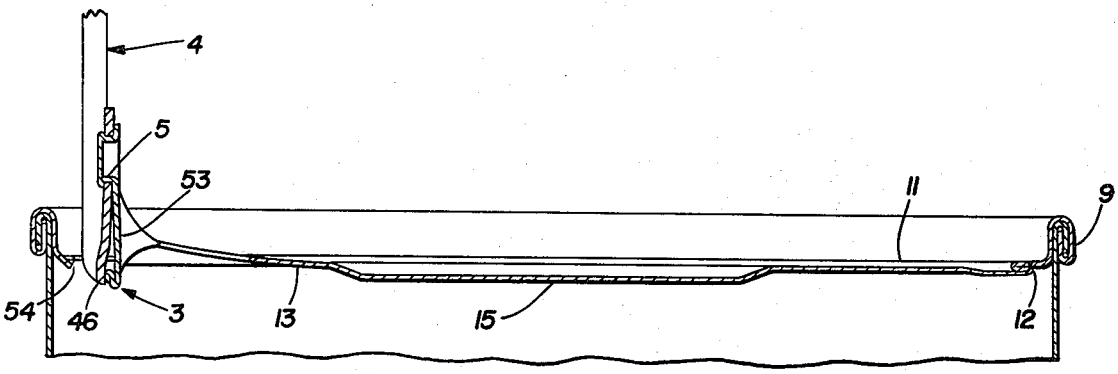
Figure 20:
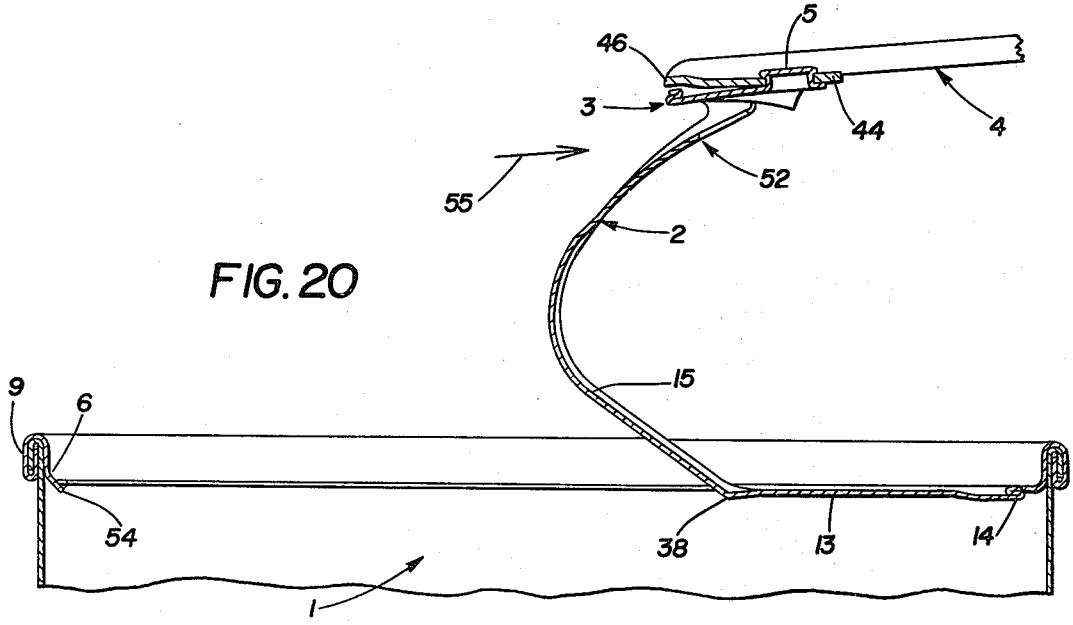

FIG . 13 is a fragmentary enlarged cross-sectional view illustrating the V-shaped score line;

FIG. 14 is a longitudinal sectional view through the aluminum pull tab ready to be staked to the can end of FIG. 6;

FIG. 15 is a sectional view similar to FIG. 14 showing the pull tab staked to the can end looking in the direction of the arrows 15—15, FIG. 7;

FIG. 16 is a greatly enlarged view of the dies used to form the bubble in the can end illustrated in FIGS. 3 and 8;

FIG. 17 shows a portion of a can with the improved steel can end thereon ready to be opened;

FIG. 18 is a view similar to FIG. 17 showing the first stage in the opening procedure when the heel of the pull tab is initially lifted to pop the moustache cut open;

FIG. 19 is a similar view showing the second stage of opening wherein leverage is applied by the pull tab when rotated toward a vertical position to wipe the pull tab tip across and into the score line to initiate rupturing of the score line; and FIG. 20 is a similar view showing the last stage of opening wherein the can end is torn out along the score line to provide a substantially full opening for the can, with the torn-out portion and pull tab still attached to the can.

Similar numerals refer to similar parts throughout the various figures of the drawings.

DESCRIPTION OF THE PREFERRED EMBODIMENTS

Figure 1:
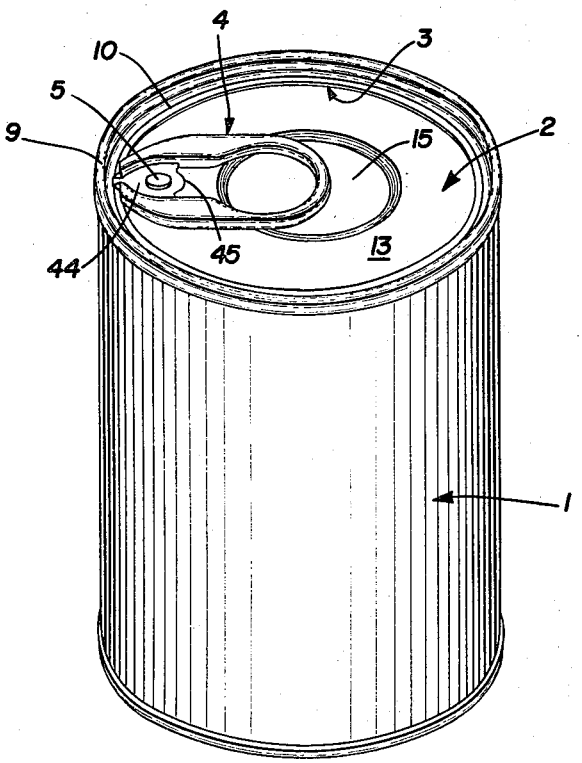
FIG. 1 is a perspective view of a steel can with the new steel can end construction seamed to the upper end of the can.

A generally typical steel can body 1 is illustrated in FIG. 1 with the improved steel can end generally indicated at 2 seamed to the upper end of the side wall of the can body. The steel can end 2 (FIGS. 7 and 15) may be made generally, but with modification, in the manner described in U.S. Pat. Nos. 3,871,314 and 4,116,361. Also the triple fold formation 3 provided in the can end 2 may be modified from the constructions shown in U.S. Pat. Nos. 4,116,360 and 4,116,361. A pull tab generally indicated at 4 may be riveted at 5 to the can end, the pull tab 4 having a construction modified from that shown in U.S. Pat. No. 4,042,144. The various modifications indicated are described in detail below.

Figure 12:
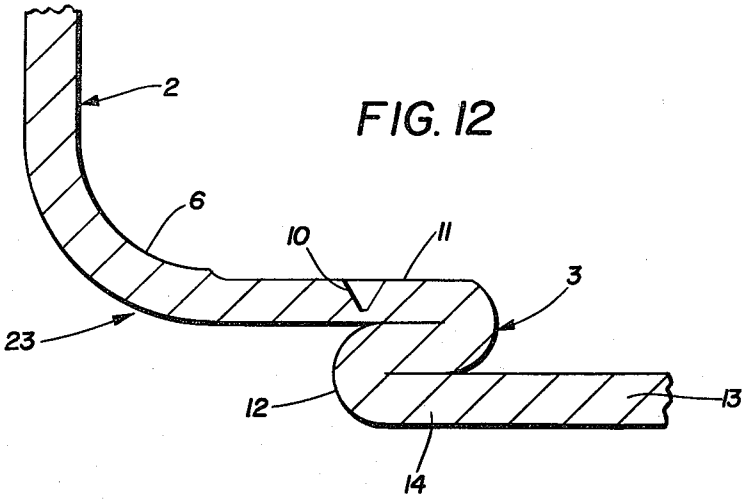
FIG. 12 is an enlarged fragmentary sectional view looking in the direction of the arrows 12—12, FIG. 6, showing the triple fold formation.

FIG. 12 illustrates in general the triple fold formation in the can end which extends 360° around the can end, spaced inward from the can end corner 6. The end wall extends from corner 6 to a curved upward and outward portion 7, terminating in a curled periphery 8 which forms part of the usual double seam 9 when the can end 2 is seamed to the can body 1 (FIG. 1).

Figure 13:
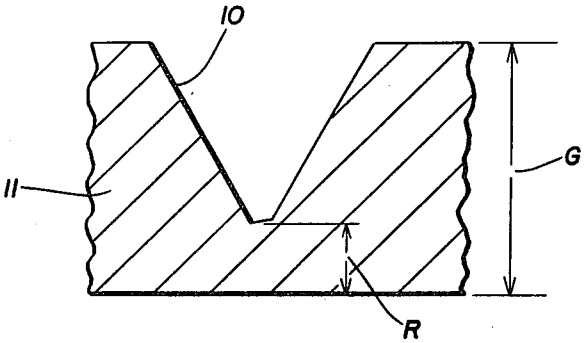

The score line 10, generally V-shaped in cross section with a slight flat at the bottom of the vee (FIGS. 12 and 13), which defines the opening to be formed in the can end 2, is located in the top layer 11 of the triple fold formation 3 above and spaced slightly radially inward of the rounded wall 12 connecting the middle and bottom layer portions of the triple fold 3. The main panel portion 13 of the can end 2 lies in the plane of and extends inward from the bottom layer 14 of the triple fold 3. Preferably a central recess 15 is formed in the can end 2 for a purpose to be described.

Initially, in attempting to manufacture a full opening can end from steel rather than from aluminum, the general procedure set forth in U.S. Pat. Nos. 3,871,314 and 4,116,361 was used but had to be modified. The contour of the panel portion shown in U.S. Pat. No. 4,116,361, including a flat panel portion 13 extending inward of and in the plane of the bottom layer 14 of the triple fold formation 3 (except for the central recess 15) was used. The raised panel portion was omitted surrounded by a groove between the raised panel portion and the triple fold shown in the aluminum can end described in U.S. Pat. No. 4,116,360.

Figure 2:
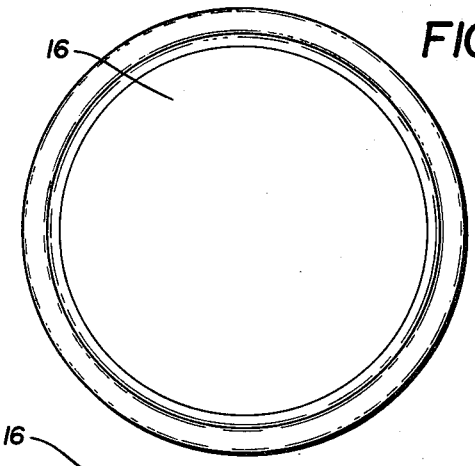
FIG. 2 is a diagrammatic plan view of a steel can end blank from which the new steel can end construction is formed.
Figure 2A:
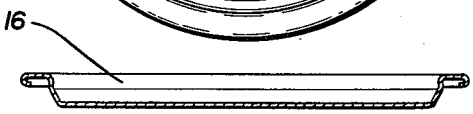
FIG. 2A is a cross section of the starting blank of FIG. 2.
Figure 4:
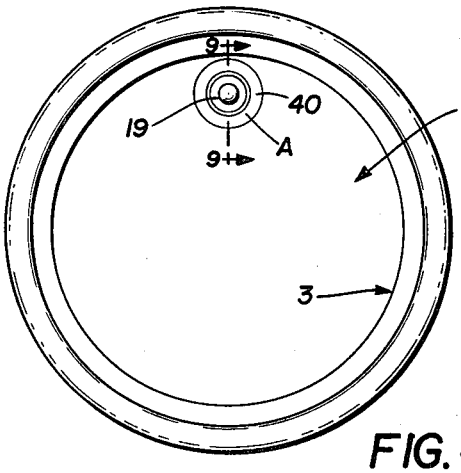
FIG. 4 is a similar view showing the stage blank of FIG. 3 with the rivet formation completed.

This modified procedure is illustrated in FIGS. 2 through 7 wherein the various stage blanks as well as the starting blank 16 and the final can end 2 are illustrated. A usual cup-shaped and flanged starting blank 16 is drawn as illustrated in FIGS. 2 and 2A from light gauge steel. The next step is to draw a bubble formation 17 in the starting blank 16, to provide the stage blank 18. The next step is to complete the rivet formation 19 in stage blank 18 to form the stage blank 20. In this manner the bubble formation 17 and surrounding metal at the base of the rivet formation 19 is reshaped.

Figure 5:
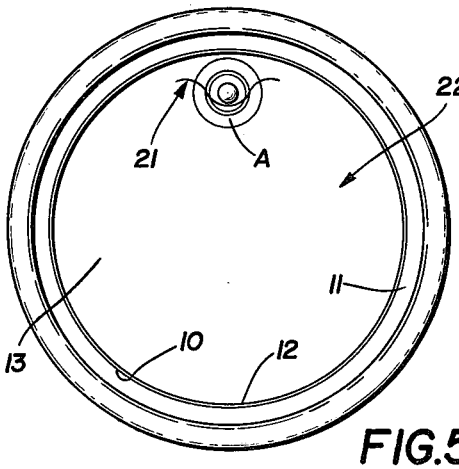
FIG. 5 is a similar view showing a moustache cut and score line formed in the stage blank of FIG. 4.
Figure 10:
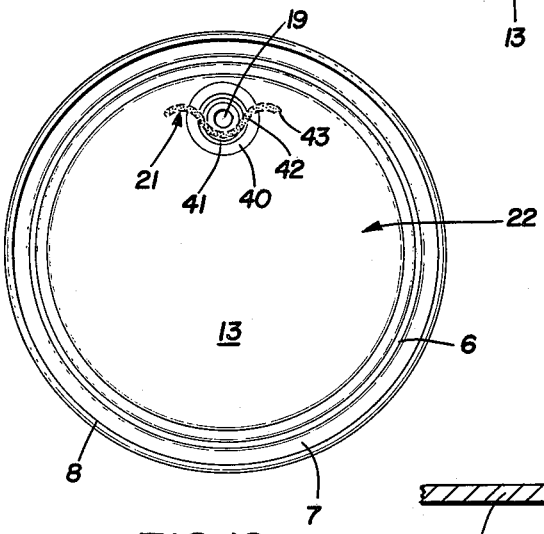
FIG. 10 is a view similar to FIG. 5 looking at the underside of the can end.

In the next stage operation the score line 10 and a moustache cut 21 are formed to produce the stage blank 22 (FIGS. 5 and 10). The next operation involves forming the triple fold 3 extending below the score line 10 (FIG. 12) to produce the final stage blank 23 (FIG. 6).

Finally, the completed steel can end 2 is formed by staking a pull tab 4 to the final stage blank 23 with the completed rivet 5 as shown in FIGS. 7 and 15.

As indicated, the procedure of U.S. Pat. Nos. 3,871,314 and 4,116,361 was modified in initial attempts to manufacture a steel can end 2 in accordance with the steps of FIGS. 2 through 7. This modification resulted because it was discovered in attempting to form the can end 2 from steel rather than from aluminum, that in the final forming of the rivet formation 19 under the prior art procedure to produce the stage blank 20, gathering or wrinkling of the metal at the base of the rivet formation 19 occurred in an area surrounding the base of the rivet formation. This area where such gathering or wrinkling occurred in prior art procedure is diagrammatically indicated at A in FIGS. 4 and 9. Such gathered metal in area A in part prevented a satisfactory full overlap of the rivet head from being obtained when the pull tab 4 was staked to the can end 2 as in FIGS. 7 and 15.

In order to eliminate the gathering of metal at A at the base of the rivet and to obtain an efficient and satisfactory full overlap when staking the rivet 5 to the pull tab 4, the entire shape and character of the bubble formed in stage blank 18 was changed to that shown in FIGS. 8 and 16.

A greatly enlarged sectional view of the dies used to form the bubble formation 17 is shown in FIG. 16. The lower die 24 has a rounded central portion 25 merging into a conical surface 26 which is connected by a circumferential rounded fillet 27 to flat die surface 28. The upper die 29 has a central opening 30 therein connected by a curved surface 31 with a conical surface 32 matching the conical surface 26 of the lower die. The conical surface 32 terminates in a curved wall 33 connected with the surrounding flat surface 34.

The dies 24–29 are used to form the bubble portion 17 in the starting blank 16 to form the stage blank 18 as shown in FIG. 8. Portions of the stage blank with the bubble 17 being formed therein also are shown in FIG. 16. The bubble formation 17 has a rounded central wall 35 at the top of a cylindrical neck 36 which is connected with the conical wall 37. Wall 37 merges into the panel portion 13 of the stage blank 18 which is also the panel portion 13 of the steel can end 2 (FIG. 7), which is torn away along the score line 10 when the can end 2 is opened.

In forming the bubble portion 17 in the dies 24–29, the metal in the conical wall 37 is substantially thinned, and cold-worked by the pressure between the conical surfaces 26 and 32 of the dies 24–29. This cold-working and thinning causes metal to flow upward within the central opening 30 in the upper die 29 to form the neck 36. The neck 36 terminates or is closed by a wall or cap 35 which is slightly bowed upwardly.

This bowed or rounded cap 35 is not cold-worked to any material degree except as a result of the slight lateral squeezing pressure imparted to the metal in being forced into the die opening 30. Thus, the bowed cap 35 of the bubble formation 17 remains relatively soft. The height of the bowed cap 35 when formed in the dies 24–29 (FIG. 16) should not extend beyond 0.123" from the bottom surface of the panel portion 13 the metal thickness of which is approximately 0.0083", the gauge of the steel from which the can ends are made.

When the bubble formation 17 is redrawn and reshaped to the rivet formation 19 (FIG. 9), the height of the cap 35 above the top surface of the panel portion 13 is substantially reduced with respect to its height above the panel portion 13 in FIG. 8.

Figure 9:
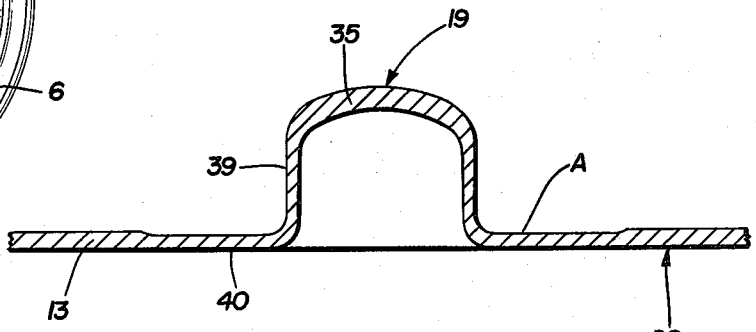
FIG. 9 is a similar enlarged section looking in the direction of the arrows 9—9, FIG. 4.

In reducing the height of the cap 35 to the location shown in FIG. 9 to produce the rivet formation 19 in stage blank 20 (FIG. 9), the conical wall 37 in stage blank 18 is redrawn and reshaped to form the cylindrical rivet neck 39 and the flat ringlike area 40 surrounding the base or lower end of the rivet formation 19.

The metal in area 40 is coined and cold-worked and substantially flat and free of wrinkles. This is the area where wrinkles were formed, when using the prior art procedure, and where wrinkles were located in the discussion of the area designated A. The portions 39 and 40 of the stage blank 20 thus are cold-worked and stiffened and somewhat thinner than the remaining metal in the panel portion 13 where the rivet formation 19 is located.

The characteristics of the score line 10 in the steel can end 2 are very important (FIG. 13) since the metal thickness between the bottom of the vee and the undersurface of the top layer 11 of the triple fold formation 3, the "residual", should be 0.0023" plus or minus 0.0003", indicated at R, where the gauge of the steel from which the can ends are made is nominally 0.0083", indicated at G. This relationship is critical or vital so that the residual is small enough to permit the panel portion 13 to be torn from the can when being opened by an aluminum pull tab 3 and yet the residual is sufficient to maintain integrity of the can end during shipment, handling, storage and use of steel cans 1 filled with food product and closed by the new steel can end 2.

As indicated, the score line preferably extends 300° around the can end so that when the can end is opened, as shown in FIG. 20, a 60° segment of the panel portion 13 remains attached to the can to avoid littering with an open can and a separate torn-out portion. This is much to be desired in the use of and opening of cans, even though a 60° segment of the panel portion 13 remains attached to the can when the torn-out panel portion is bent up as shown in FIG. 20 along a bend area 38. Essentially the bend area 38 is a chord defining the 60° segment described. However, the open area in the can end (FIG. 20) is substantially a full opening in the can to all intents and purposes.

Obviously in those instances where retention of the torn-out portion on the can is neither desired nor required, the score line may extend 360° around the can end to permit complete tear out of a panel portion 13.

Other modifications of prior art constructions referred to were required in order to permit the use of an aluminum pull tab substantially the same as that shown in U.S. Pat. No. 4,042,144 and to prevent such pull tabs from being torn adjacent the rivet connection to the can ends when opening the new steel can end 2.

Figure 11:
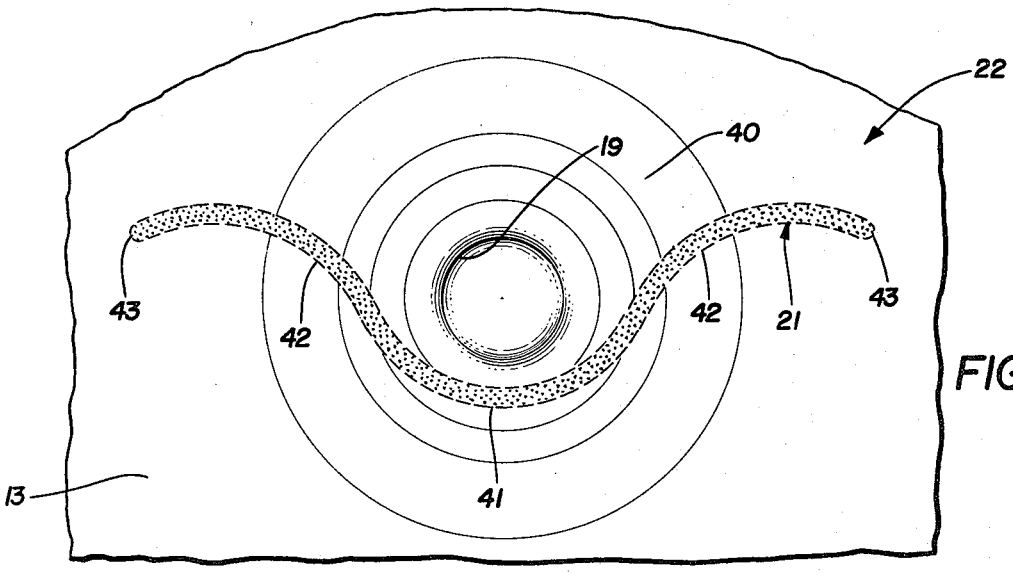
FIG. 11 is a greatly enlarged view of a portion of FIG. 10 illustrating the location of the moustache cut with reference to the rivet.

These modifications involve slight changes in the shape and contour of the aluminum pull tab to be described, and the provision of a so-called moustache cut 21 in the rivet area A (FIGS. 5, 10 and 11). Moustache cuts have been known and are old in the beverage can field, where a teardrop opening is formed by complete or bending removal of can end portions from within the outline of the teardrop. The teardrop opening is formed by manipulating a pull tab riveted to the removed portion usually with a rivet located at the center of the can. These prior beverage cans usually have been formed of aluminum and the moustache cut is located behind the rivet so that the moustache cut is ruptured first during the initial opening movement of the pull tab to permit relief of pressure from within the can through the very small moustache cut opening from below the hand of the user and below the pull tab.

However, in accordance with the present invention, the moustache cut is used for an entirely different purpose (not for pressure relief) but in a steel can end in which an aluminum pull tab is riveted to a steel triple fold protected can end close to the full opening score line provided in the steel can end.

The function of the moustache cut is to enable the pull tab acting as a lever initially to rupture the panel portion immediately behind the rivet and close to the score line so that after the panel portion is ruptured the stiff and strong aluminum pull tab again acting as a lever ruptures the main score line with the tip of the pull tab as a second stage of can opening procedure. Then in a third stage of the procedure the pull tab is pulled upward to tear the panel portion along the score line.

Such coordination between the moustache cut, rivet, rivet location and pull tab characteristics have been found to substantially avoid the likelihood of an aluminum pull tab being torn from the can end during the process of attempting to open a steel can end.

It was discovered in developing the can end of the invention that the moustache cut 21 had to be located as close as possible to the rivet formation 19 with its curved central portion 41 encompassing the rear of the rivet formation 19 and extending in the panel portion 13 laterally outwardly at each side of the rivet formation 19 at 42, and terminating in curved wings or extremities 43 as indicated somewhat diagrammatically in FIG. 11. The laterally outwardly extending portions and curved wings 42–43 as shown in FIG. 11 lie laterally in front of the front portion of the rivet formation 19.

Although FIGS. 10 and 11 view the underside of the stage blank 22, and the moustache cut 21 is formed in the top surface of the panel portion 13 (FIG. 5), the working of the metal in forming the moustache cut score line 21 produces a shiny area of some width, having the moustache cut shape, on the underside of the panel portion 13 as indicated diagrammatically by stipling the substantial width of the outlined moustache cut shape appearing as a cold-worked metal on the underside of the panel portion 13, not only in FIG. 11 but also in FIG. 10.

The curved central portion 41 of the moustache cut 21 should be located at approximately 0.094" away from the center of the rivet formation 19 in order to achieve its function. This locates the curved central portion 41 immediately over the flat ringlike area 40 described above at A in connection with completing the rivet formation 19 as shown in FIG. 9. The ringlike area 40 formed in stage blank 20 (FIG. 4) thus becomes the area wherein portions of the moustache cut are formed in producing the stage blank 22 of FIG. 5. The location of the moustache cut in the cold-worked ringlike area 40 was not feasible until the problems relating to wrinkling in the area A were eliminated.

Moustache cuts also are known in full opening aluminum can end construction as shown in U.S. Pat. No. 4,182,460 where a moustache cut is located on the inside panel surface at the rear of a rivet staking a pull tab to a removable panel defined by a score line extending 360° around the can end. Here again the purpose or function of the moustache cut as stated in said U.S. Pat. No. 4,182,460 is for venting the interior of the container as in beverage cans.

Further, this prior construction does not involve a removable panel portion having a triple fold protected edge. In addition, the pull tab has a blunt nose formed by a flange extending downward perpendicular to the panel portion around the periphery of the nose and engages the panel portion at a location spaced a considerable distance radially inward of the score line to be ruptured by the pull tab as shown in said U.S. Pat. No. 4,182,460.

The modifications involving changes in the shape and contour of the aluminum pull tab relate to modifying the construction shown in U.S. Pat. No. 4,042,144. In the prior construction the nose bottom wall has an ear formed therein with which the rivet is engaged surrounded at its sides by lanced cutout areas, which permit a hinge action to occur extending between the ends of the lanced portions in front of the rivet when the pull tab is used to open a can as illustrated in U.S. Pat. No. 4,042,144.

This structure is modified in the aluminum pull tab forming part of the can end construction of the invention, by eliminating these prior art lanced portions so that the nose bottom wall 44 (FIGS. 1 and 7) is unlanced or not cut out at the sides of the rivet 5 around the opening 47 through which the rivet 5 extends. In this manner, the nose bottom wall 44 has a slightly curved rear edge 45 (FIG. 7) lying entirely behind and spaced from the opening 47 for rivet 5 so as to prevent any hinging of the pull tab on a bend line in the nose bottom wall 44 in front of the rivet.

Another modification in the aluminum pull tab construction involving changes in the shape and construction which characterize the present invention relates to the nose or tip of the pull tab and to the stepped formation therein indicated at 46 and referred to as a "stepped tip". This stepped tip has a height of 0.005" from the bottom of the stepped tip 46 to the under-surface 44*a* of the nose bottom wall 44 (FIG. 14) when the steel can end is made of nominal 0.0083" gauge steel. This stepped tip height is very substantially less than the height of the stepped tip in the prior patent in order to achieve the purposes of the invention.

The stepped tip 46, the location of the rivet 5 with respect to the stepped tip 46 and the location of the panel portion 13 in the plane of the bottom layer 14 of the triple fold formation 3 (FIG. 15) preloads the pull tab 4 when staked to the steel can end 2 as shown in FIGS. 1, 7 and 15.

In this preloaded condition, the stepped tip 46 is engaged with the triple fold formation 3 at the inner portion of the top layer 11 of the triple fold where it curves downwardly to join the middle triple fold layer, and the outer end of the stepped tip overlies the score line groove 10, and the flat panel portion 13 is deflected upwardly a slight degree between the triple fold formation 3 and the rivet 5 as indicated in FIG. 15 by the space 50 between the nose bottom wall 44 of the pull tab 4 and the top surface of the panel portion 13.

The described cooperative and interrelated relationship between the various parts of the can end 2, its triple fold formation 3, pull tab 4 and rivet 5 establish conditions which permit the ready and easy opening of the can end 2 when formed of steel with an aluminum pull tab as described in connection with FIGS. 17 to 20.

The upper end of a can 1 closed by the new steel can end construction 2 is illustrated in FIG. 17. When it is desired to open the can end, the rear end 49 of the pull tab 4 is engaged by a finger 51 of the user behind the heel 48 as shown in FIG. 18 and said rear end 49 is raised. As the rear end of the pull tab 4 is thus raised the moustache cut pops, indicated at 52, as a first step in the opening sequence by the lever action of the pull tab 4 pulling the rivet 5 upward with the stepped tip of the pull tab 4 engaged on the triple fold formation 3.

As the pull tab continues to be raised to a vertical position such as shown in FIG. 19 during the second step in the opening sequence the metal panel portion pops at the front of the pull tab stepped tip as the stepped tip wipes inward across the score line 10 accompanied by bending of the panel portion 13 in the region of the wings 43 of the moustache cut 21 beyond the ends of said wings 43. During this stage in the opening procedure the metal in the panel portion 13 along the bent portions beyond the ends of the wings 43 continues to stay connected by the rivet 5 with and to extend adjacent to the nose bottom wall 44 as generally indicated at 53 in FIG. 19.

As the stepped tip 46 of the pull tab 4 wipes across the score line 10 a little nick or depression indicated at 54 in FIGS. 19 and 20 is formed in the portion of the can end remaining connected to the corner 6 adjacent the double seam 9.

The pull tab 4 then is pulled upward and rearward generally in the direction of the arrow 55 in FIG. 20, to complete the final step of the opening sequence for the steel can end construction providing the can 1 with the substantially full opening while retaining the torn panel portion 13 and its pull tab 4 connected to the can 1.

After overcoming all of the problems encountered in the construction and use of a steel can end opened with an aluminum pull tab to enable easy opening of the can end, it was determined that the construction would not satisfactorily comply with or pass government Drop Test requirements indicated by "leakers" which sometimes occurred when the filled cans closed by the new steel can end construction were subjected to Drop Tests.

This problem was finally overcome by changing the type and physical properties of the steel used to form the new steel can end construction. The new construction was able to pass the required Drop Tests when the steel can ends are made of 75# (nominal 0.0083") Tin-free Steel, Single Reduced Mill Rolled, Temper 4, 7C Finish, Continuous Anneal, Continuous Cast Aluminum Deoxidized. It is believed that this particular type of steel sufficiently changes the physical characteristics of the metal in the areas adjacent the moustache cut and the main score line, where the metal has been cold-worked in the manufacture of the can ends, so that the residuals of the score line and moustache cut having the dimensions necessary to permit easy opening, resist splitting or fracturing by the shock forces to which the cans and can ends are subjected when the Drop Tests are made.

Accordingly, the improved steel can end construction having the cooperative and interrelated relationships between the various parts and components of the steel can end and its protective triple fold and its aluminum tab described, results in a steel food can product capable of being very easily opened with a substantially full opening and with the torn-out portions of the can end remaining connected to the can, which satisfies a need in the canned food products field that has long existed, thereby achieving the indicated objectives simply and efficiently and with lower cost than food cans having prior triple fold protected aluminum can ends, and solving existing problems in the canned food products field.

In the foregoing description, certain terms have been used for brevity, clearness, and understanding; but no unnecessary limitations are to be implied therefrom beyond the requirements of the prior art because such terms are used for descriptive purposes and are intended to be broadly construed.

Moreover, the description and illustration of the invention is by way of example, and the scope of the invention is not limited to the exact details shown or described, since the features of the invention may be applied to different sizes and types of cans and steel can ends.

Having now described the features, discoveries and principles of the invention, the manner in which the improved structures achieve the objectives, and the advantageous, new and useful results obtained; the new and useful structures, devices, elements, arrangements, parts, components, cooperative arrangements of components, and combinations are set forth in the appended claims.

We claim:

1. In a metal can end of a type having a seam flange adapted to be connected by seam means to a food products can body and having a recessed corner located below the seam flange with an end wall extending inward from the recessed corner, and having a triple fold formation extending entirely around the end wall, with a score line located close to said recessed corner and extending around the end wall in the top layer of the triple fold defining a removable panel portion in the end wall, with the triple fold forming a protective peripheral edge on the panel portion when torn along the score line by an aluminum pull tab connected by a rivet formed integrally in the panel portion and located close to the score line, and with the removable panel portion of the end wall extending flatwise inward in the plane of the bottom layer of the panel portion protective peripheral triple fold formation, the pull tab having a flat nose bottom wall with an opening formed in its rear portion through which the rivet extends when the pull tab is staked to the removable panel portion and with a stepped tip formed at its front terminal portion and with its flat bottom wall held flatwise around the rivet by the rivet in contact with the flatwise extending panel portion when staked by the rivet to the panel portion; wherein the improvement comprises an annealed, tempered, tin-free steel can end; the pull tab stepped tip engaging the triple fold formation at an inner portion of the top layer of the triple fold where it curves downwardly to join the middle triple fold layer; the outer end of the stepped tip overlying the score line; and a moustache cut formed in the upper surface of the flatwise extending panel portion close to the rivet and encompassing the rear and sides of the rivet and terminating in wings lying laterally in front of the front portion of the rivet.

2. The construction defined in claim 1 in which the score line extends at least 300° around the end wall, whereby the removable panel portion when torn along the score line provides substantially a full opening for the can but remains attached to the can end.

3. The construction defined in claim 1 in which the steel can end has a thickness of 0.0083 inches, and in which the score line residual thickness is 0.0023 inches.

4. The construction defined in claim 1 in which the flat nose bottom wall of the aluminum pull tab is unlanced around an opening formed in said nose wall through which the rivet extends, and has a rear edge extending entirely behind and spaced from said rivet opening.

5. The construction defined in claim 1 in which the area surrounding the base of the rivet formed in the panel portion comprises cold-worked, thinned, wrinkle-free metal wherein the rivet-encompassing-portion of the moustache cut is formed.

6. The construction defined in claim 5 in which the moustache cut rivet-encompassing-portion is spaced 0.094 inches from the rivet center.

7. The construction defined in claim 1 in which the height of the under-surface of the pull tab stepped tip above the under-surface of the nose bottom wall is 0.005 inches, and in which the steel can end thickness is 0.0083 inches thereby forming a space between the pull tab nose bottom wall and the top surface of the panel portion adjacent the triple fold formation which panel portion is deflected upwardly along said space toward the rivet which stakes the pull tab to the panel portion.

8. The construction defined in claim 1 in which the pull tab is preloaded between the rivet and the stepped tip when the pull tab is staked to the can end by the rivet.

9. The construction defined in claim 1 in which the height of the under-surface of the pull tab stepped tip above the under-surface of the nose bottom wall is 0.005 inches; in which the steel can end thickness is 0.0083 inches thereby forming a space between the pull tab nose bottom wall and the top surface of the panel portion adjacent the triple fold formation which panel portion is deflected upwardly along said space toward the rivet which stakes the pull tab to the panel portion; in which the score line extends at least 300° around the end wall; in which the score line residual thickness is 0.0023 inches; in which the flat nose bottom wall of the aluminum pull tab is unlanced around an opening formed in said nose wall through which the rivet extends, and has a rear edge extending entirely behind and spaced from said rivet opening; in which the area surrounding the base of the rivet formed in the panel portion comprises cold-worked, thinned, wrinkle-free metal wherein the rivet-encompassing-portion of the moustache cut is formed; in which the moustache cut rivet-encompassing-portion is spaced 0.094 inches from the rivet center; in which a central recess is formed in the flat panel portion; and in which the pull tab is preloaded between the rivet and the stepped tip when the pull tab is staked to the can end by the rivet.

* * * * *